US005118109A

United States Patent [19]

Gumina

[11] Patent Number: 5,118,109

[45] Date of Patent: Jun. 2, 1992

[54] INSTANT POKER GAME CARD

[75] Inventor: Anthony Gumina, Las Vegas, Nev.

[73] Assignee: Champions Management Group, Inc., Las Vegas, Nev.

[21] Appl. No.: 693,702

[22] Filed: Apr. 30, 1991

[51] Int. Cl.[5] ..... A63F 3/06

[52] U.S. Cl. ..... 273/139; 283/901; 283/903

[58] Field of Search ..... 273/139, 138 R, 153 R; 283/901, 903, 100-103

[56] References Cited

FOREIGN PATENT DOCUMENTS 1580768 12/1980 United Kingdom ..... 273/139

2075918 11/1981 United Kingdom ..... 283/903

OTHER PUBLICATIONS

Michigan Legionnaire, Wild Deuces—Michigan state lottery advertisement, p. 15, Oct. 1978.

*Primary Examiner*—Benjamin Layno

*Attorney, Agent, or Firm*—Shlesinger Arkwright & Garvey

[57] ABSTRACT

An instant poker game card having portions thereof covered with a removable scratch-off coating, which when removed, reveals symbols indicating the cards of a poker hand. The card also includes other scratch-off portions which indicate possible combinations which can be kept from the initial starting hand which allows a player to draw any number of additional cards in an effort to improve the rankings of the final hand. The result of the game is judged according to the normal poker rankings of one pair, two pair, three of a kind, straight, flush, full house, four of a kind, straight flush, and royal flush.

11 Claims, 5 Drawing Sheets

INSTANT POKER GAME CARD

FIELD OF THE INVENTION

This invention relates to a game piece having a scratch-off coating thereon. The game is played by selectively scratching off the coating in certain areas of the game piece to remove the coating and reveal the underlining indicia.

BACKGROUND OF THE INVENTION

This invention embodies the relatively new concept of the scratch-off game piece such as a lottery card or promotional ticket and combines that idea with the traditional game of draw poker. Thus a new form of the lottery game has been created in which the lottery ticket becomes a game piece which combines the added perspective of using a player's knowledge and familiarity with a skill game to enhance player interest. This additional versatility of the game piece raises level of interest above that of the conventional lottery ticket without adding any skill requirement to the game format.

The game of draw poker is generally played by dealing to each player five (5) cards. After viewing the cards and various players placing their bets, then each player is allowed to try and improve his hand by keeping some of the better cards and drawing new cards as replacements for the lesser valuable cards which are discarded. For example, if a player is dealt five cards with those five being a king and two queens and a four and a six, the player may want to discard the four and the six and retain a pair of queens with a king high hand in hopes of getting a full house or two pair or three of a kind or four of a kind. In that case, the player would draw two additional cards to replace the four and the six which were discarded. After drawing the two additional cards then the player decides to bet or fold or call.

It is on these principles that the game piece of the present invention is based. However, instead of being dealt cards from a deck, new cards are added by selectively scratching off an opaque layer to uncover the new card value. If the player selects a winning hand, the card is redeemed for a prize award.

FEATURES AND SUMMARY OF THE INVENTION

One of the principle features of the disclosed invention is a game piece having a substrate and having at least one layer of indicia covering a portion of the substrate and a scratch-off coating covering areas of the indicia to keep those areas hidden from view until the game is played.

Another feature of the invention is to provide a game piece having indicia thereon representing the cards of a hand of a card game.

Another feature of the disclosed invention is to provide indicia on the game piece indicating the cards of a poker hand.

Still another feature of the invention is to provide a game piece having additional indicia representing other possible combinations of cards for a poker hand representing additional replacement cards for those cards discarded from the original starting hand of the poker game.

Yet another feature of the invention is to provide a game piece having all possible combinations of selecting 1, 2 or 3 cards to replace selected cards of the original starting hand.

Yet another feature of the invention is to provide a game wherein the chances of winning can be controlled by the game piece manufacturer.

Another object of the invention is to provide a winner verification number on each hand to verify the prize payout for that hand.

In summary, therefore, this invention is directed to articles such as game pieces having indicia thereon representing selected cards of a deck of playing cards covered by scratch-off material.

It should also be understood that the game piece could also be applied to other games of chance such as games involving throwing dice or other card games such as blackjack.

The invention is particularly directed to playing five card poker, in which the game is based on the traditional game having four suits: diamonds, hearts, clubs and spades, and each suit having ace, deuce, three, four, five, six, seven, eight, nine, ten, jack, queen and king. Jokers may also be used if desired.

A starting area on the game piece may be initially covered with a scratch-off material. After the starting hand has been revealed, another area may be scratched off to produce new cards in an effort to improve the value of the original starting hand. The game piece can include enough optional selections to make the game interesting or up to all possible combinations of drawing one, two, three or four cards or completely replacing the original hand by drawing five new cards. The entertainment factor of the game is high because a player may have several chances to win on each game piece.

These and other features and advantages of the invention will be readily apparent in view of the following description and drawings of the above described invention.

DETAILED DESCRIPTION OF THE INVENTION

Figure 1:
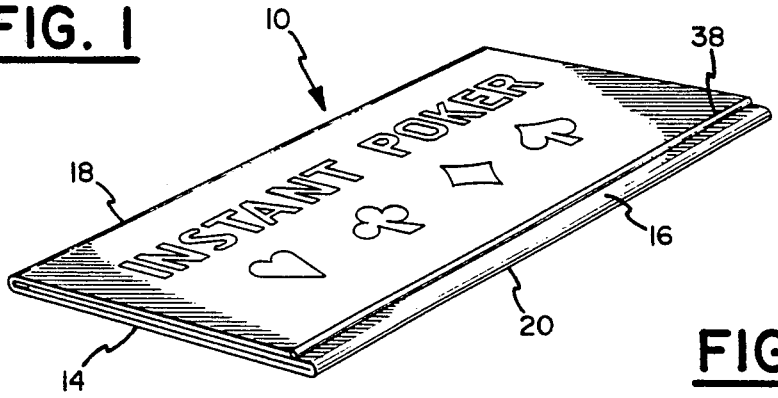
FIG. 1 is a perspective view of the game piece in its folded state prior to initiating the game.
Figure 2:
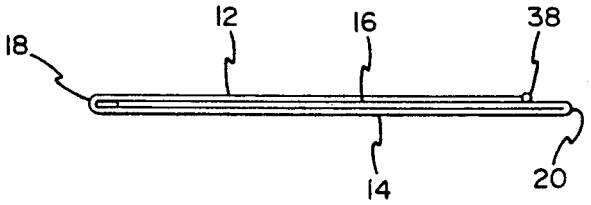
FIG. 2 is a cross-sectional view of the game piece taken along line 2—2 showing the connecting strips and bead line; and, FIG. 3 is a perspective view of the game piece as it is unfolded to begin play.

Referring now to FIGS. 1 and 2, a game piece 10 is shown folded in an envelope configuration, preferably having a single sheet of material forming substrate folded into three panel sections 12, 14 and 16. Panels 12 and 14 are joined along fold line 18. Panels 14 and 16 are joined along fold line 20.

Figure 3:
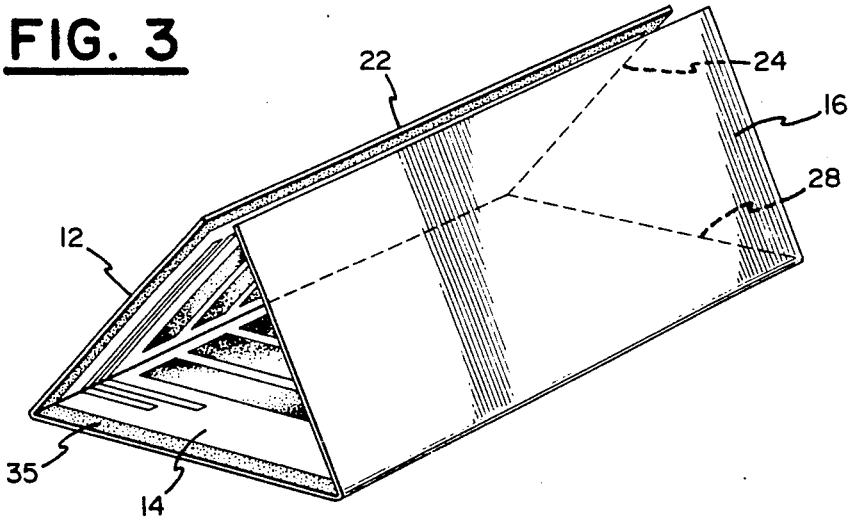

The folding sequence is shown in FIG. 3 where panel 16 is folded inwardly first to lie flat against panel 14. Then panel 12 is folded down to overlie panel 16.

Figure 4:
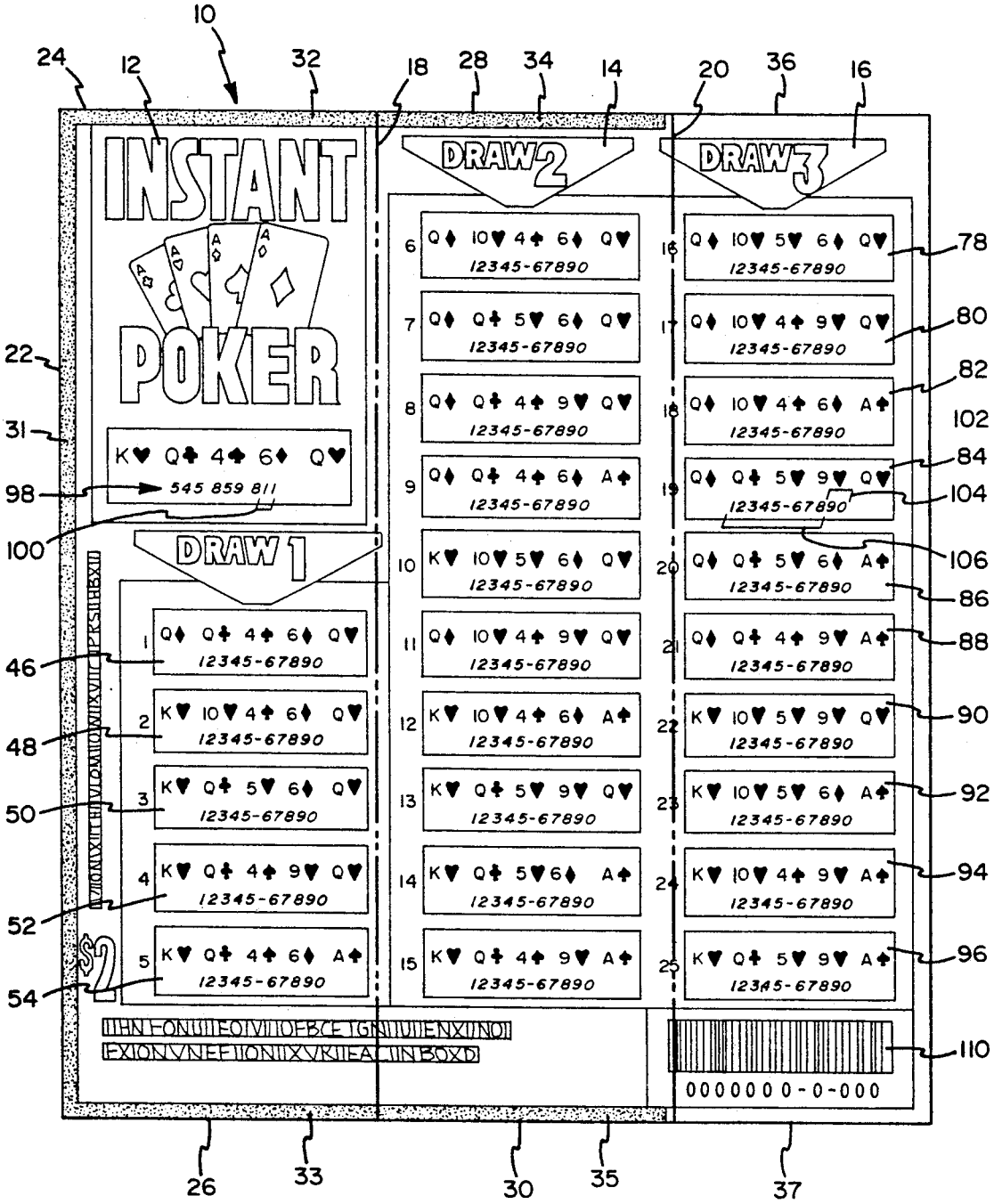
FIGS. 4 and 5 show the preferred embodiment of the game piece having indicia thereon before and after application of the opaque layer; and, FIG. 5 is a perspective view of another embodiment of the game piece having a tape strip closure.

As best shown in FIG. 4, panel 12 has a left edge 22 and top and bottom edges 24 and 26, respectively. Panel 14 includes top edge 28 and bottom edge 30. Panel 12 has adhesive strips 31, 32 and 33 applied adjacent the edges 22, 24, and 26 respectively. Panel 14 includes adhesive strips 34 and 35 adjacent edges 28 and 30 respectively.

As shown in FIG. 2, the game piece 10 is sealed along its edges 22, 24, 28 and 30, to prohibit viewing an uncovered starting hand prior to acquisition by a legitimate player.

As the game piece 10 is folded into an envelope configuration, panel 16 is folded upwardly so that its top and bottom edges 36 and 37 engage adhesive-covered edges 28 and 30 of panel 14. Panel 12 is then folded down and adhesive-covered edges 22, 24 and 26 engage panel 16 and the envelope is securely sealed until purchased by a potential player. It is very important from the standpoint of security to prevent someone from reviewing the starting hand prior to opening the game piece 10. As an additional security measure, a frangible bead line 38 of adhesive material may be laid along edge 22 which will be broken when the game piece 10 is unfolded and thereby warn a potential purchaser of tampering.

Figure 6:
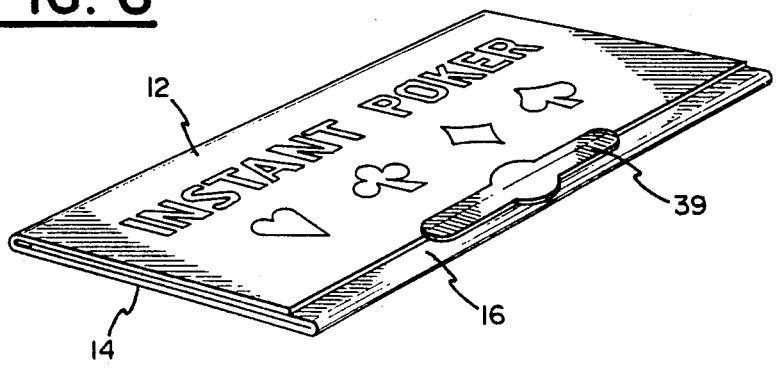

FIG. 6 shows an alternate means of detecting tampering with the game piece 10, by application of a seal 39 joining panel to panel 16.

Figure 5:
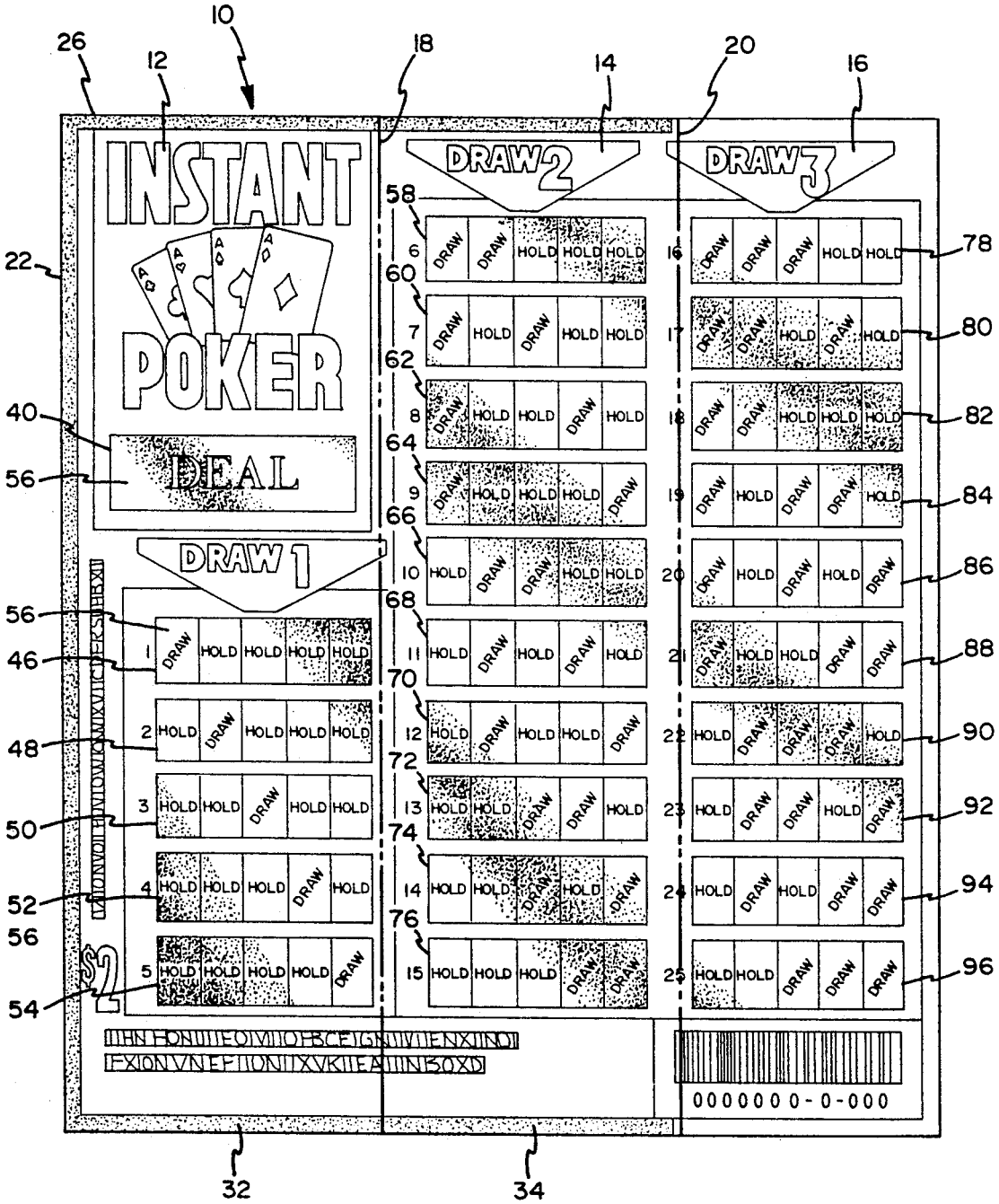

Now referring to FIGS. 4 and 5, the poker game, which is the preferred embodiment of the invention, is shown having boxes having two indicia therein representing the face value 42 and suit 44 of an individual card of a deck of playing cards. The game piece 10 also includes a series of alternate choices which simulate discarding unwanted cards and picking up new cards as in a real game of poker.

The values of a hand of poker are based on the usual combinations as listed in ascending order beginning with two pair, three of a kind, a straight, a flush, a full house, four of a kind, a straight flush and a royal flush. Typically, a schedule showing the prize for obtaining a hand of a certain value will be printed either on the exterior of the game piece 10 or the schedule could be posted near the point of sale for review by the player.

In panel 12 the starting hand is shown on the left side and five selection sets 46, 48, 50, 52 and 54 are shown below in which one of the cards of the original starting hand is replaced. The replacement hand is initially hidden beneath the scratch-off layer of opaque material 56 as shown in FIG. 5, which hides the new "hand" from view until the choice of a card to be replaced is made. The scratch-off material is the same kind of material used in lottery tickets, usually a blend of latex materials. Alternatively, two cards of the starting hand may be replaced from the ten selection sets 58, 60, 62 64, 66, 68, 70, 72, 74, 76 of panel 14 or three cards may be selected from the ten selection sets 78, 80, 82, 84, 86, 88, 90, 92, 94 and 96 of panel 16.

In each game piece 10, the cards selected will occur as they would have been drawn from a deck. In the block of choices or sets 46–54 of panel 12, the card under each of the scratch-off layers 56 is the same, for example, the three of diamonds. In the sets 58–76 of panel 14 the cards represented beneath the scratch-off layers 56 would be the same two cards for each set, for example, the three of diamonds and four of hearts and one of those cards would match the card under each of sets 46–54 of panel 12. In sets 78–96 of panel 16, the three hidden cards for example, the three of diamonds, four of hearts, and five of clubs are the same for each set and two of the three cards are identical to the cards in each of sets 58–76 of panel 14. This format gives a realistic effect to the poker game which would not be found if the cards had random values.

The instant poker game piece 10 is designed to be about the same size as a conventional lottery ticket when folded and is formed of a paper or plastic substrate which is initially printed with the indicia representing the card values 42 and suits 44 with the starting hand and each of the alternate hands or sets 46–54 and 58–96 being printed in lines. After the printing is dried, opaque scratch-off material 56 is applied, covering selected boxes 40 with opaque scratch-off material 56. In order to manufacture the game pieces 10 on a high-speed printing machine, the scratch-off material 56 is applied to the same spots on each successive game piece 10. The card values 42 and suits 44 are changed during the printing operation to make each game piece 10 different. It should be understood that the starting hand of different game pieces 10 may be altered or the hidden cards beneath opaque player 56 may be altered.

OPERATION

To begin the game, the game piece is obtained in the folded condition as shown in FIG. 1 with the edges 24, 26, 28, 30, 36, and 37 being aligned. The panels are released and the game piece 10 is opened as shown in FIG. 3 until it is completely unfolded as shown in FIG. 4.

After the game piece is fully opened, the player can see the box 40 of the starting hand. Scratching of opaque layer 56 reveals individual card values 42 and their suit 44.

In the game of instant poker the entire starting hand is viewable. As in the game of draw poker the player may select one, two or three cards in an effort to improve the value of the starting hand. A key feature is the step by step process the player must use in opening the card and then making a decision about an appropriate selection and then scratching off the opaque material 56.

In order to improve the starting hand of FIG. 4, the player would have 25 options. In each set of options 46–54 and 58–96, the retained cards are shown and the new cards are covered by an opaque layer of scratch-off material 56. For example, line 60 indicates that the king of hearts and the four of spades are being discarded and the queen of clubs, six of diamonds and queen of hearts are being retained.

However, part of the object of the game and the purpose for including a line for each possible discarded card and replacement, is that the player is forced to choose which card or cards will be replaced from the starting hand prior to finding out what the new card value will be.

The particular layout of the game is required to allow a player with a good understanding of the rules of the game of poker to exercise the player's skill in choosing which cards to discard and which cards to keep.

In order to obtain the largest prize a player might select line 90 discarding the queen of clubs, the four of spades, the six of diamonds and retaining the king of hearts and the queen of hearts in the hopes of getting a royal flush. A more conservative player may choose line 72 and retain a pair of queens with a king high and in order to hopefully obtain three of a kind or a full house or perhaps two pairs of kings and queens. Another option may be to keep both queens as in line 84 and select three additional cards.

The foregoing description of choices adds a degree of interest to the game and can be used as a factor to determine the odds of a player winning a prize. The manufacturer of the game piece 10 can produce the game with predetermined values under the scratch-off layers 56 so that a skilled poker player will have improved or equal odds of winning over the novice who makes a random decision about which cards to keep and which to discard. As shown in FIG. 4 each ticket will have a nine digit verification number. The nine digits will include an eight digit unique number 98 and a variable prize designator number 100.

Each hand will also have a prize amount designator 102. This prize designator will be an eight digit unique verification 104 number plus an identifier 106 for that hand. Identifiers 106 indicate the ticket value. The verification numbers 98 and the hand verification numbers 104 provide a security check to prevent unauthorized use or duplication of the instant game card 10. In FIG. 4, the prize identifier 106 is ninety for nonwinning hands such as 48, 50, 52 and 54 and is 45 for a winning hand 46 or 60, or 62.

A bar code 110 including the bar code identification number is also printed o the ticket 10 to identify batches of tickets.

DESCRIPTION OF THE PREFERRED EMBODIMENT

Figure 7:
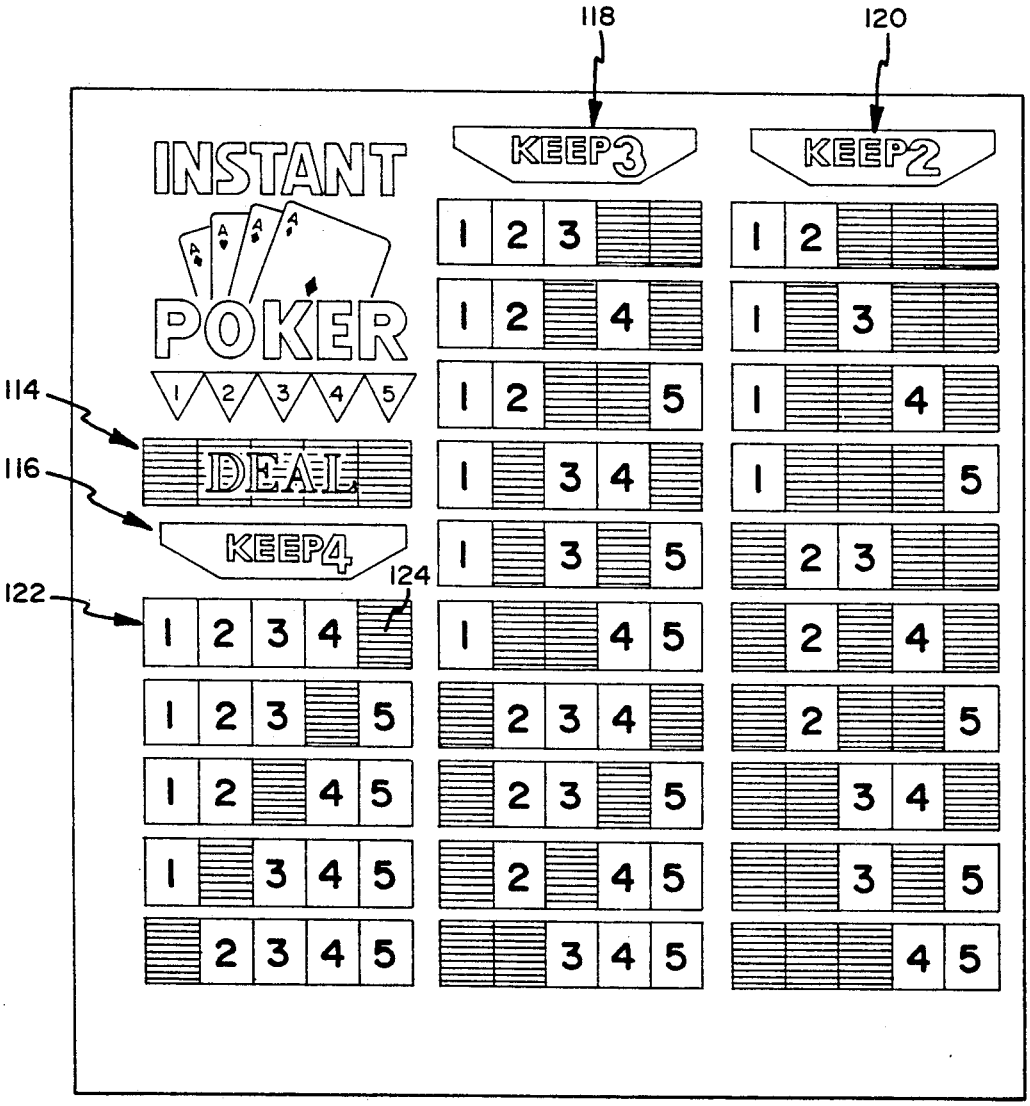
Figure 8:
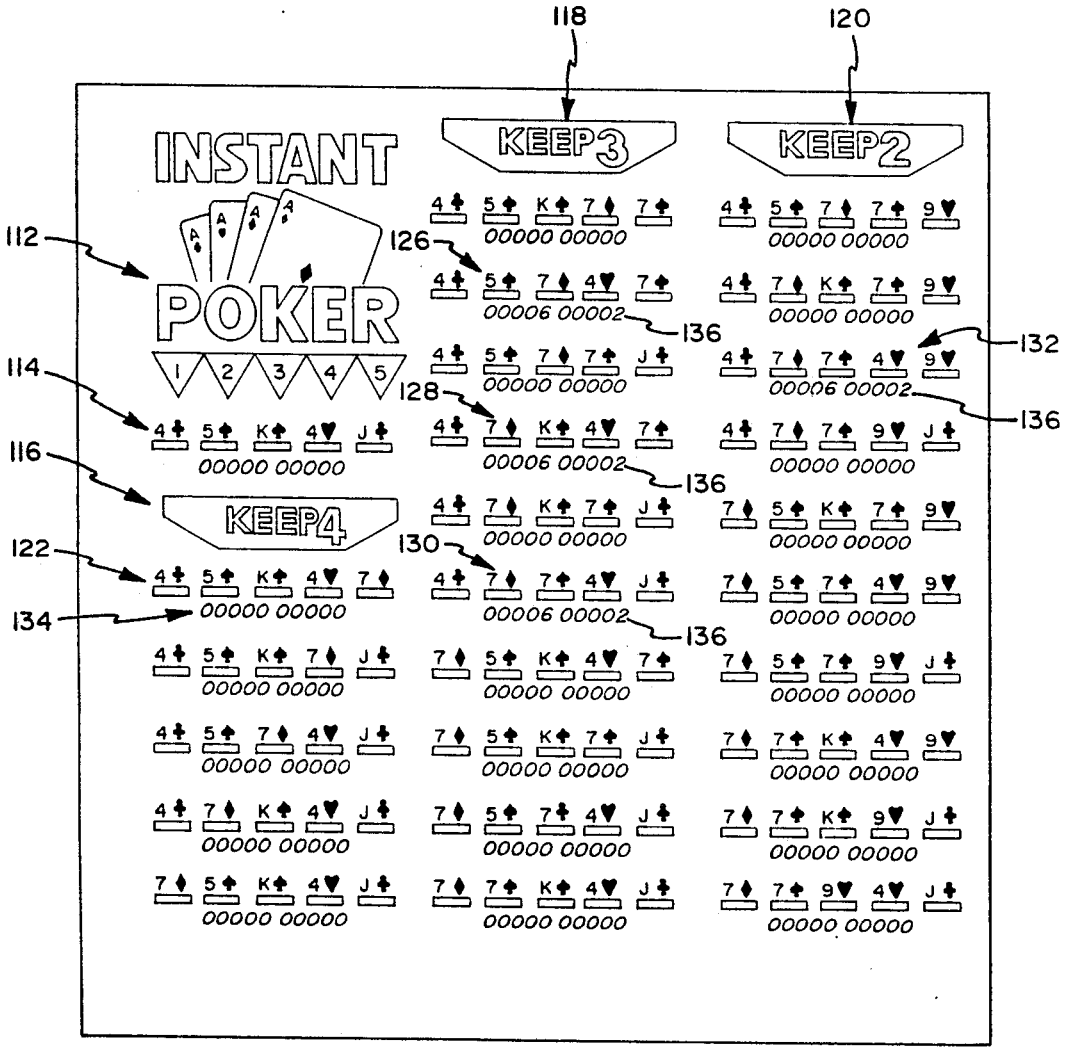

FIGS. 7 and 8 illustrate the preferred form of the invention which uses a flat unfolded card 112. As shown in FIG. 7, the initial deal of five cards 114 is initially covered by a layer of scratch-off material such as a latex blend as is known in the art. After the deal has been uncovered, the player can select to keep four of the cards dealt, three of the cards dealt or two of the cards dealt as shown by the keep four column 116, the keep three column 118 and the keep two column 120.

Each of the columns 116, 118, and 120 include rows of five boxes. Each of the five boxes represent one card of a hand. The numbered boxes of the first row 122 of the keep four column 116, for example, includes box numbers 1, 2, 3, and 4 on top of an opaque scratch-off material. The last box 124 is not covered with a number, and indicates the card from the original deal 114 which is being replaced.

FIG. 8 shows the game card of FIG. 7 without the opaque latex coating covering the individual hands and the dealt hand.

As can be seen from the keep four column 116, when one card is selected, that card value will be the replacement value for each of the cards of the hand. This is very realistic to the regular game of poker where the card drawn would be the top card on the deck. So no matter which card was being discarded only one replacement card would be available.

In the keep three column 118, two cards can be selected. One of the cards selected is the same seven of diamonds as shown in the keep four column 116 and the second card is the seven of clubs. The same two cards will be drawn regardless of which two cards are chosen to be replaced from the dealt hand 114. In the keep two column 120, three cards are replaced. The three cards will be the seven of diamonds, the seven of spades and the nine of hearts. These three cards will be the replacement cards regardless of which three cards of the original dealt hand are chosen to be replaced. It should be understood that the examples given are only for an individual card and other cards would of course have different combinations of card values printed thereon.

As can be seen, four of the possible choices will obtain a winning hand. In the keep three column, the second row 126, the fourth row 128 and the sixth row 130 all show pairs of fours and sevens. In the keep two column, the third row 132 shows pairs of fours and sevens.

As stated in respect to the previous embodiment, each hand includes a code number 134 associated therewith. Each winning hand 126, 128, 130 and 132 includes a separate code number 136 which verifies a winning hand. It should be understood that more or less winning hands could be present in the card 112.

The game is played as previously described with the former embodiment wherein the deal is uncovered first and then a choice has to be made by the player to keep four cards, three cards or two cards. The player must also choose which one, two, or three cards to replace out of the dealt hand after the selection has been made, the player scratches off the row corresponding to the cards which the player wishes to retain and those to be discarded.

While this invention has been described as having a preferred design it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention and the limits of the appended claims.

I claim:

1. A game piece, comprising:

a) a substrate, b) printed indicia on said substrate representing individual playing cards;

c) a layer of opaque scratch-off material covering said indicia;

d) said indicia being printed into groups, with each group representing a hand of playing cards;

e) a first group indicating a starting hand f) a second group indicating the starting hand after at least one of said cards of said hand have been replaced; and, g) a series of groups representing the starting hand after one of said cards of said starting hand has been replaced; and, h) said series including each possible resulting combination.

2. The game piece as defined in claim 1, further comprising:

a) a series of groups wherein two of the original cards of the starting hand are replaced, and b) said series includes each possible combination of two card replacement..

3. The game piece as define din claim 1, further comprising:

a) a series of groups indicating the starting hand after three of the original cards have been replaced; and, b) said series indicating all possible combinations for replacement of three cards.

4. The game piece as defined in claim 1, further comprising:

a) a series of groups; and, b) said series including combinations of replacement of cards of the starting hand.

5. The game piece as defined in claim 1, wherein:

a) said second set includes alternate cards for all of the cards of the starting hand.

6. The game piece as defined in claim 1, wherein:

a) said indicia represents playing cards for playing the game of draw poker.

7. The game piece as defined in claim 1, wherein:

a) each hand of playing cards includes five cards.

8. The game piece as defined in claim 1, wherein:

a) said printed indicia on said substrate includes a prize designation for each of said hands.

9. The game piece as defined in claim 1, wherein:

a) said printed indicia also represents at least one unique verification number.

10. The game piece as defined in claim 1, further comprising:

a) a series of groups wherein two of the original cards of the starting hand are replaced, and b) said series includes each possible combination of two card replacement wherein the same values for the two replacement cards are used in each combination.

11. The game piece as defined in claim 1, further comprising:

a) a series of groups wherein three of the original cards of the starting hand are replaced, and b) said series includes each possible combination of three card replacement wherein the same values for the three replacement cards are used in each combination.

* * * * *

UNITED STATES PATENT AND TRADEMARK OFFICE

CERTIFICATE OF CORRECTION

PATENT NO. : 5,118,109

DATED : June 2, 1992

INVENTOR(S) : Anthony Gumina

It is certified that error appears in the above-indentified patent and that said Letters Patent is hereby corrected as shown below:

ON THE TITLE PAGE:

Item [73] Assignee: Webcraft Games, Inc. of North Brunswick, New Jersey should be listed as the joint assignee.

Signed and Sealed this

Seventeenth Day of October, 1995

*Attest:*

*Attesting Officer*

BRUCE LEHMAN

*Commissioner of Patents and Trademarks*